United States Patent [19]

Yamashita

[11] Patent Number: 4,765,043

[45] Date of Patent: Aug. 23, 1988

[54] APPARATUS FOR REMOVING RESIDUAL ROVINGS ON ROVING BOBBINS

[75] Inventor: Osamu Yamashita, Kanazawa, Japan

[73] Assignee: Murao Boki Kabushiki Kaisha, Kanazawa, Japan

[21] Appl. No.: 919,691

[22] Filed: Oct. 16, 1986

[30] Foreign Application Priority Data

Oct. 16, 1985 [JP] Japan ..... 60-230624
Oct. 17, 1985 [JP] Japan ..... 60-231498

[51] Int. Cl.[4] ..... B65H 73/00
[52] U.S. Cl. ..... 28/294
[58] Field of Search ..... 28/292, 293, 294

[56] References Cited

U.S. PATENT DOCUMENTS

| | | | |
|---|---|---|---|
| 2,834,090 | 5/1958 | Vowles | 28/294 |
| 2,865,081 | 12/1958 | Moos | 28/294 |
| 3,528,150 | 9/1970 | Schmid | 28/294 |
| 3,940,825 | 3/1976 | Murao | 28/294 |

FOREIGN PATENT DOCUMENTS

| | | | |
|---|---|---|---|
| 4626412 | 7/1971 | Japan | 28/293 |
| 4626413 | 7/1971 | Japan | 28/293 |
| 46-26414 | 7/1971 | Japan | 28/293 |

*Primary Examiner*—Robert R. Mackey

*Attorney, Agent, or Firm*—Wenderoth, Lind & Ponack

[57] ABSTRACT

An apparatus for removing residual rovings on roving bobbins in a most efficient manner. A roving bobbin has an annular sticking cloth secured to a portion of the peripheral surface thereof for attaching of a wind-starting end of a roving wound around the roving bobbin. The roving bobbin is rotated in a direction in which the roving is wound around the roving bobbin. A jet of air is directed toward the sticking cloth substantially in a tangential direction thereof in such a manner as to oppose the rotation of the roving bobbin, thereby removing residual portions of the roving attached to the surface of the sticking cloth. The apparatus is adapted to be incorporated in a bobbin conveyance device and has a flocked belt for removing residual rovings on roving bobbins and adapted to travel in parallel with a plurality of roving bobbins which are being conveyed by bobbin hangers while being rotatably hung therefrom; a rockable frame for urging the roving bobbins against the flocked belt through presser members; and a comb wheel adapted to rotate at a peripheral speed greater than the travelling speed of the flocked belt while being in contact at its comb-like tip portions with the flocked belt for stripping off the residual rovings attached to the flocked belt.

9 Claims, 5 Drawing Sheets

APPARATUS FOR REMOVING RESIDUAL ROVINGS ON ROVING BOBBINS

BACKGROUND OF THE INVENTION

1. Field of the Invention

This invention relates to an apparatus for removing residual rovings on roving bobbins in which rovings are wound onto roving bobbins in a roving frame and unwound therefrom in a ring spinning frame.

2. Description of the Prior Art

In roving techniques, slivers are drawn and twisted to form rovings by means of a roving frame, and the rovings thus formed are wound around roving bobbins by a flyer mechanism and then conveyed and fed to a ring spinning frame. Such a process is generally recognized to be most important in spinning mills.

When a wind-starting end of a roving is attached or fastened to a portion of a cylindrical peripheral wall of a tube of a roving bobbin, it becomes very easy and smooth to start winding the roving by means of a flyer mechanism, and therefore, various efforts have been made to this end. Recently, a measure is employed in which a wind-starting end of a roving is fastened to a special flocked fabric such as a so-called sticking cloth annularly secured to a tube of a roving bobbin, the flocked fabric being made by implanting hairs formed of an elastomeric synthetic resin such as nylon on a ground fabric, and laying down the hairs in one direction so as to form a brush-like surface.

In the above measure, the winding direction of the roving around the bobbin is opposite to the direction in which the hairs emplanted on the surface of the ground fabric are laid down so that fibers forming the roving can be intimately attached to the hairs on the sticking cloth.

In cases where the roving, after having been wound around the roving bobbin according to the above measure, is unwound from the bobbin mounted on a creel in a ring spinning frame, a tendency will unavoidably occur that a lot of fibers still remain on the surface of the sticking cloth even when the roving has been removed from the bobbin. This is because a part of the fibers forming the roving is strongly entangled with the hairs on the sticking cloth. Such fibers remaining on the surface of the sticking cloth (hereinafter referred to as residual fibers) act to substantially reduce adhesion or intimate contact between a wind-starting end of a new roving and the sticking cloth. Thus, in the past, the residual fibers have usually been removed from the sticking cloth by hand, which is very inefficient.

In recent years, in order to facilitate labor saving in spinning mills, bobbin conveyance apparatuses have been widely used which function to continuously return to a roving frame empty roving bobbins, from which rovings have been unwound by means of a ring spinning frame, while the roving bobbins are hung from bobbin hangers in a line.

Due to the necessity for reducing a possibility of rovings being disconnected in a ring spinning frame, a roving is not completely unwound from a bobbin by the ring spinning frame but a small portion of the roving is left thereon so that a new roving cannot be connected with such a roving bobbin. As a result, such a roving bobbin can not be reused in a roving frame and hence development of a novel apparatus has been earnestly desired which is capable of removing residual rovings from roving bobbins in an efficient manner during conveyance of the bobbins from a ring spinning frame to a roving frame by a bobbin conveyance device, but no satisfactory apparatus has yet been reduced into practice.

SUMMARY OF THE INVENTION

In view of the above, an object of the present invention is to provide a novel and improved method for removing residual rovings from roving bobbins in which residual rovings attached to a sticking cloth can be removed in a most efficient manner by blowing off the residual rovings with a jet or air.

Another object of the present invention is to provide a novel and improved apparatus for removing residual rovings on roving bobbins in which a predetermined number of roving bobbins are caused to contact a flocked belt for removal of residual rovings while being hung from bobbin hangers during conveyance of the roving bobbins by means of a bobbin conveyance device so that the residual rovings on the roving bobbins can be removed therefrom in a most efficient manner.

According to the present invention, there is provided an apparatus for removing residual rovings on roving bobbins adapted to be incorporated in a bobbin conveyance device which comprises:

- a flocked belt for removing residual rovings on roving bobbins and adapted to travel in parallel with a plurality of roving bobbins which are being conveyed by bobbin hangers while being rotatably hung therefrom;
- a rockable frame for urging the roving bobbins against the flocked belt through presser members; and
- a comb wheel adapted to rotate at a peripheral speed greater than the travelling speed of the flocked belt while being in contact at its comb-like tip portions with the flocked belt for stripping off the residual rovings attached to the flocked belt.

In a preferred embodiment, the rockable frame comprises an L-shaped frame having a horizontal portion and a upright portion and adapted to be rockable around a pivot shaft, the upright portion having the presser members mounted thereon, the horizontal portion being providing at its distal end with a roller rotatably mounted thereon, the roller being received in a stepped cam which is driven to reciprocate in a horizontal direction by drive means so that the upright portion of the rockable frame is caused to rock around the pivot shaft between an upright position in which the presser members are placed in contact with the roving bobbins for urging them against the flocked belt, and an inclined position in which the presser members are apart from the roving bobbins.

It is preferred that the flocked belt and the comb wheel move forward in unison in synchronism with the rocking motion of the upright portion of the rockable frame toward the upright position so that the roving bobbins are held between the rockable frame and the flocked belt.

Each of the roving bobbins has an annular sticking cloth secured to the peripheral surface thereof for attaching of a wind-starting end of a roving, and the rockable frame has air nozzles, one for each roving bobbin, adapted to eject air in a tangential direction of the annular sticking cloth on the corresponding one of the roving bobbins.

The flocked belt comprises a ground fabric and a lot of hairs implanted on the surface of the ground fabric, the hairs being laid down in a direction in which the flocked belt travels.

The above and other objects, features and advantages of the present invention will become apparent from the following detailed description of a few presently preferred embodiments of the invention when taken in conjunction with the accompanying drawings.

DESCRIPTION OF THE PREFERRED EMBODIMENTS

Now, the present invention will be described in detail with reference to a few presently preferred embodiments thereof as illustrated in the accompanying drawings.

Figure 1:
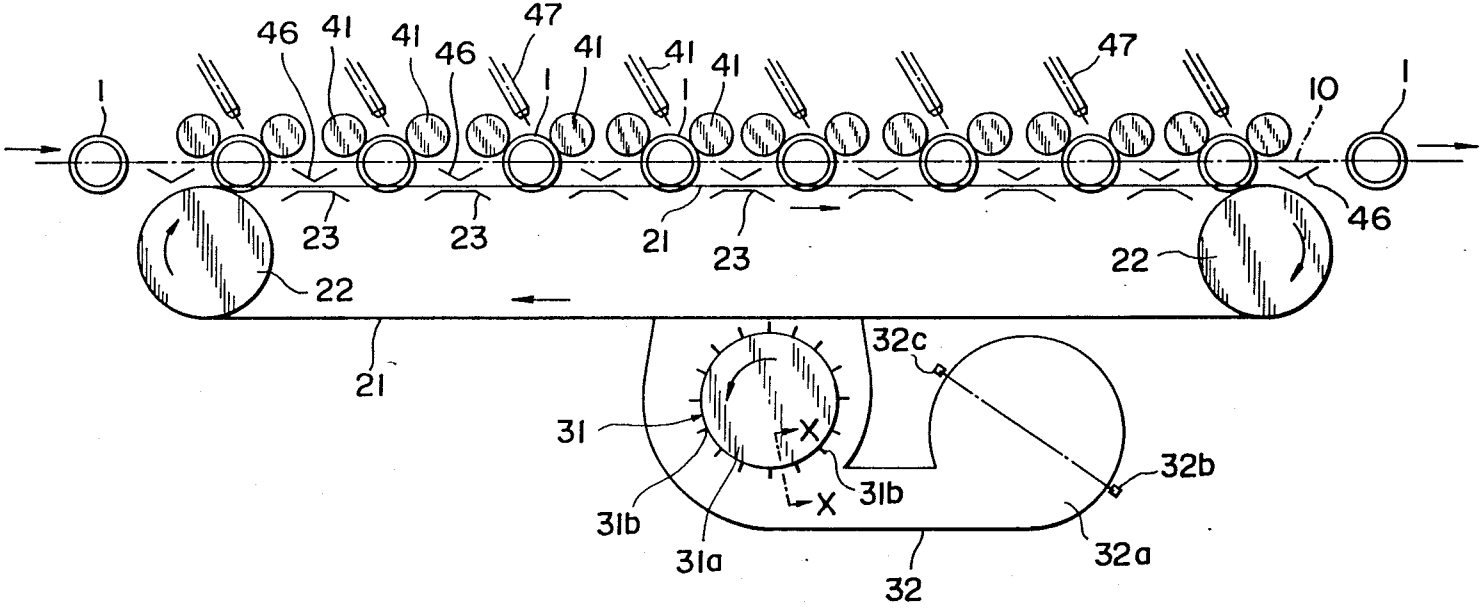
FIG. 1 is a plan view showing essential parts of an apparatus for removing residual rovings on roving bobbins in accordance with the present invention.
Figure 2:
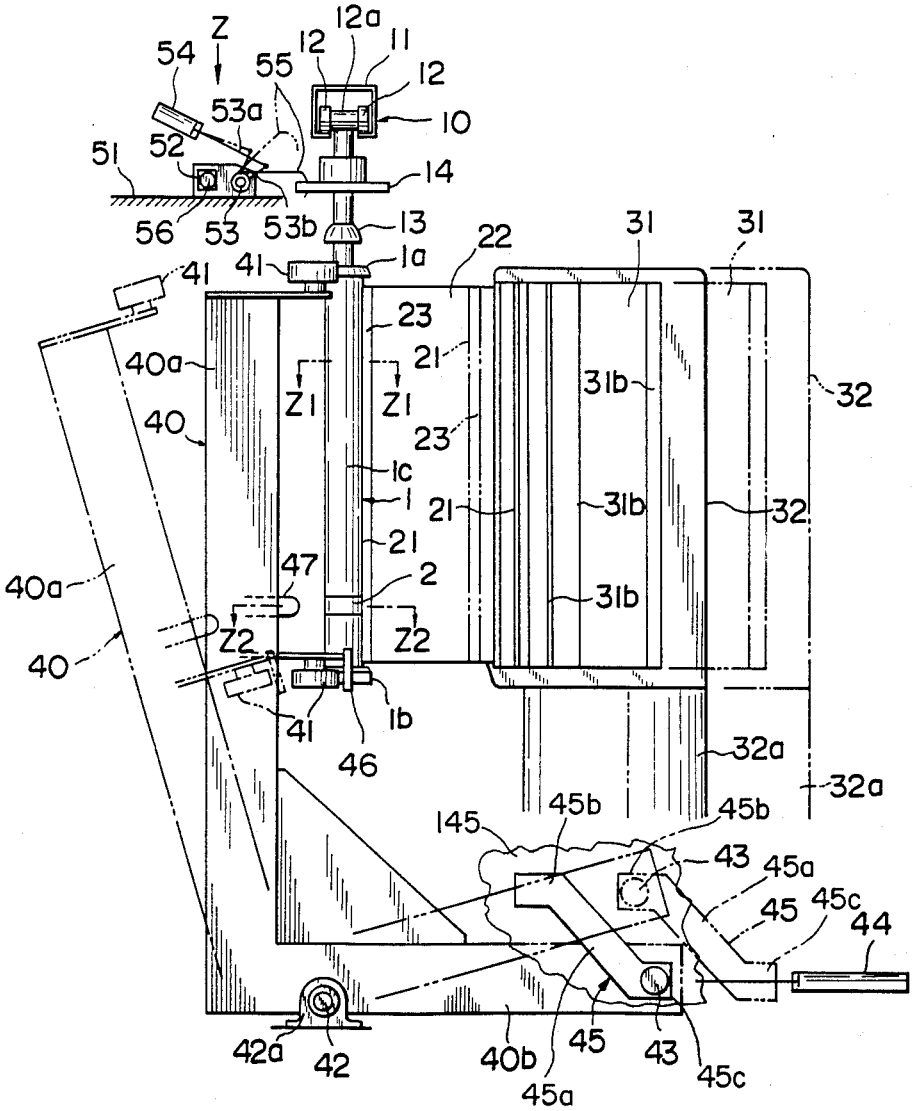
FIG. 2 is a side elevational view of the same.

In FIGS. 1 and 2, there is shown an apparatus for removing residual rovings on roving bobbins constructed in accordance with the principles of the present invention. The apparatus illustrated comprises a flocked belt 21 adapted to travel in parallel with a plurality of roving bobbins 1, 1 . . . hung or suspended in a line from a bobbin conveyance device 10, a comb wheel 31 disposed at the back side portion of the belt 21 remote from or opposite to the front side portion thereof with which the bobbins 1, 1 . . . are in contact as shown in FIG. 1, and a rockable frame 40 disposed in a face-to-face relation with the flocked belt 21 with the roving bobbins 1, 1 . . . interposed therebetween, the belt 21 and the comb wheel 31 being mounted in a unit on a slide frame (not shown) which is driven to move by a drive means 44 such as an air cylinder.

Figure 7:
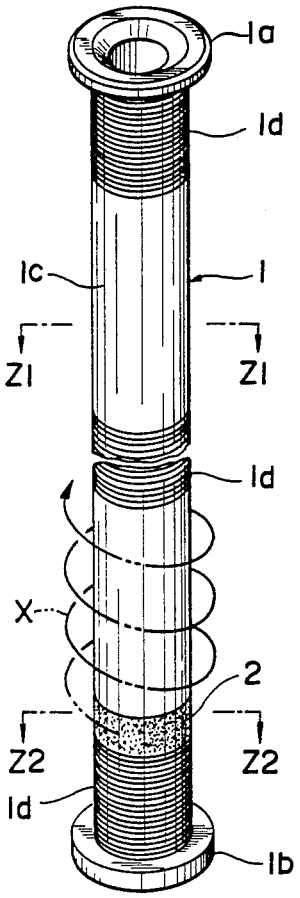
FIG. 7 is a perspective view of a roving bobbin.

One of the roving bobbins 1, 1 . . . for winding a roving therearound by a roving frame is constructed, for example, in the manner as shown in FIG. 7. Specifically, the roving bobbin 1 illustrated comprises a cylindrical tube 1*c* formed of plastic and having a pair of flanges 1*a*, 1*b* mounted on the opposite ends thereof, the tube 1*c* being provided on its outer peripheral surface with a plurality of grooved portions 1*d*, 1*d* . . . having a multitude of small annular grooves axially spaced from each other at a limited pitch for preventing axial sliding movement or displacement of a roving to be wound around the tube 1*c*.

An annular sticking cloth 2 is fixedly secured to the outer peripheral surface of the tube 1*c* at a location near the lower end thereof. Here, assume that the winding direction of a roving S around the bobbin 1 in a roving frame is in a clockwise direction viewed from the top of the bobbin 1, as illustrated in FIG. 7 by two-dot long and two short dashes line X. As clearly shown in FIG. 6, the sticking cloth 2 comprises a ground fabric 2*a* having a multitude of elastomeric hairs 2*b*, 2*b* . . . such as nylon emplanted on its outer surface so as to form a brush-like surface, the hairs being laid down to incline in a circumferential direction of the tube 1*c* which is opposite to the winding direction of the roving S designated by an arrow Z in FIG. 6. As a result, when the roving S begins to be wound around the bobbin 1, the respective fibers of the roving S are engaged with the inclined hairs 2*b*, 2*b* . . . in a direction to intimately contact with each other so that a wind-starting end of the roving S is firmly attached to the surface of the sticking cloth 2.

As seen from FIG. 2, the bobbin conveyance device 10 comprises a plurality of units each of which has a pair of wheels 12, 12 rotatably mounted on an axle shaft 12*a* and adapted to roll on the bottom portion of a rail 11 in the form of a port in cross section mounted to a ceiling surface of a housing (not shown), and a bobbin hanger 13 depending from the axle shaft 12*a* for suspending a roving bobbin 1 for rotary motion relative thereto. The plurality of units each including the wheels 12, 12 and the bobbin hanger 13 are connected with each other at appropriate intervals in a chain-like manner so as to continuously convey the roving bobbins 1, 1 . . . from a ring spinning frame to a roving frame. The bobbin hanger 13 is constructed such that a roving bobbin 1 is engageable or disengageable with the bobbin hanger 13 and inclinable relative thereto.

The flocked endless belt 21 is entrained under tension around a pair of belt wheels 22, 22, as shown in FIG. 1, and has its one side portion (or front side portion) travelling in parallel with the roving bobbins 1, 1 . . . which are hung or suspended from and being conveyed by the bobbin conveyance device 10. The width of the flocked belt 21 is slightly shorter than the length of the bobbin tube 1*c* of each roving bobbin 1 so that the belt 21 is disposed between the flanges 1*a*, 1*a* on the opposite ends of the bobbin tubes 1*c*. The distance between the belt wheels 22, 22 can be varied by means of an air cylinder (not shown) so as to adjust the tension applied to the belt 21.

Figure 5:
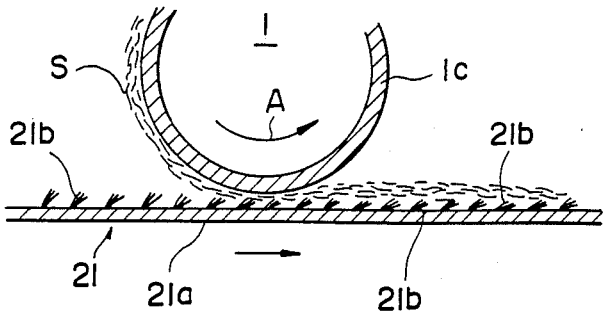
FIG. 5 is an enlarged cross section view taken along the line Z1—Z1 in FIG. 2 or in FIG. 7.
Figure 6:
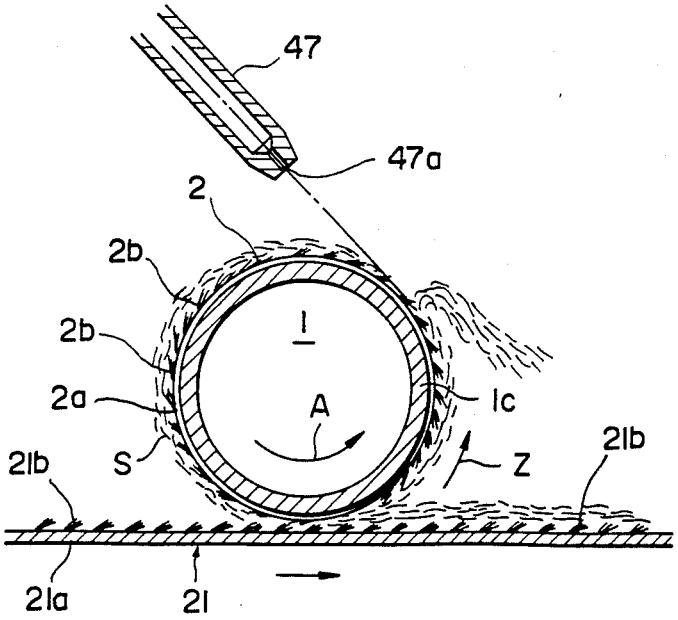
FIG. 6 is an enlarged cross sectional view taken along the Line Z2—Z2 in FIG. 2 or in FIG. 7.

As shown in FIGS. 5 and 6, the flocked belt 21 comprises a ground fabric 21*a* and a multitude of elastomeric hairs 21*b*, 21*b* . . . implanted on the front or outer surface of the ground fabric 21*a*, the hairs 21*b*, 21*b* . . . being laid down to incline in the direction in which the flocked belt 21 travels. The back or inner surface of the ground fabric 21*a* acts as a flat belt entrained around the peripheral surfaces of the respective belt wheels 22, 22.

Figure 3B:
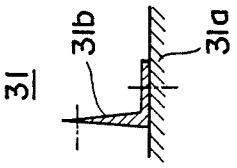
FIG. 3B is a cross section view taken along the line Y—Y in FIG. 3A.
Figure 3A:
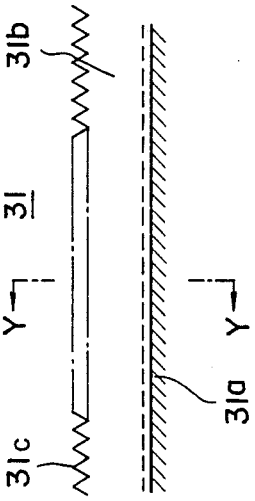
FIG. 3A is an enlarged cross sectional view taken along the line X—X in FIG. 1.

Turning to FIG. 1, the comb wheel 31 is disposed on the back side of the flocked belt 21 opposite to the front side thereof contacting the roving bobbins 1, 1 . . . and is housed in a hood 32. The comb wheel 31 has a rotary cylinder 31*a* and a plurality of comb plates 31*b*, 31*b* . . . circumferentially spaced from each other at appropriate intervals and extending radially outwardly from the outer peripheral surface of the rotary cylinder 31*a*, each of the comb plates also extending in the axial direction at least over the width of the flocked belt 21. As is clear from FIGS. 3A and 3B, each of the comb plates 31*b* is provided at its tip end with saw teeth 31*c* for combing the hairs 21*b* on the surface of the flocked belt 21 from their back side. To this end, the comb wheel 31 is caused to rotate in the travelling direction of the flocked belt 21 at a peripheral speed greater than the travelling speed of the belt 21.

Connected with the hood 32 encasing the comb wheel 31 is an opening duct 32*a*, the interior of which is maintained at a negative pressure under the action of a suction fan (not shown). A pair of photoelectric means 32*b*, 32*c* including a light emitter and a light receiver are provided on the opening duct 32*a* in a face-to-face relation with each other for detecting the presence of waste residual rovings removed from the roving bobbins 1, 1 . . . and flowing through the opening duct 32*a*.

It is to be noted that the flocked belt 21 and a belt-driving system including the belt wheels 22, 22, the comb wheel 31 and a drive system therefor (not shown), and the hood 32 are all mounted on a slide base 145 (only partially shown in FIG. 2) in a manner such that they are caused to move, under the action of the air cylinder 44, toward or away from the travelling path of the roving bobbins 1, 1 conveyed by the bobbin conveyance device 10 in a perpendicular direction relative thereto, as shown by two-dot long and two short dashes line in FIG. 2. Specifically, the operating rod of the air cylinder 44 is connected at its distal end with slide base 145 so that when the rod is extended, the slide base is moved forwards to advance the aforesaid members including the flocked belt 21, the comb wheel 31 and the like, as shown by the solid line in FIG. 2, whereas when the rod is contracted, the slide base is moved backwards to displace these members in the same direction, as shown by the two-dot chain line in FIG. 2.

As seen in FIGS. 1 and 2, a plurality of pairs of presser members or wheels 41, 41 are disposed in a row at locations opposing the flocked belt 21 with the roving bobbins 1, 1 . . . interposed therebetween. The presser wheels 41, 41 . . . are mounted on the rockable frame 40 for rotation relative thereto.

The rockable frame 40 is an L-shaped frame having an upright or vertical portion 40*a* and a horizontal portion 40*b* and, as a whole, is rockable around a pivot shaft 42. More specifically, the horizontal portion 40*b* is provided at its distal end with a roller or cam follower 43 which is rollably received in a stepped cam slot 45 provided in the aforementioned slide base 145 which is in turn driven to move in a horizontal direction by means of the air cylinder 44.

Here, it should be noted that the stepped can slot 45 has a rearwardly slanting portion 45*a* which is high at its forward and low at its rear and which is provided at its opposite ends with horizontal portions 45*b* and 45*c*. In this connection, when the operating rod of the air cylinder 44 is in an extended limit position and in a contracted limit position respectively, the stepped cam slot 45 takes the respective positions as respectively illustrated by the solid line and the two-dot chain line in FIG. 2.

Accordingly, when the rod of the air cylinder 44 is in the contracted limit position, the follower 43 rotatably mounted on the top end of the horizontal member 40*b* is located within the horizontal portion 45*b* which is ahead of the stepped cam slot 45 so that the tip of the horizontal member 40*b* is raised high, thus moving the upright member 40*a* to a position inclined in the direction away from the bobbins 1, 1 . . . , as clearly shown by the two-dot chain line in FIG. 2.

On the other hand, when the air cylinder 44 is extended, the slide base 145 is caused to move forwards along with the above members including the flocked belt 21, the comb wheel 31 and the like all of which are mounted on the slide base. Simultaneous with this, the stepped cam slot 45 on the slide base is moved forwards so that the follower 43 in the stepped cam slot 45 rolls downwards along the slant portion 45*a* so as to be pushed down. Accordingly, the rockable frame 40 is forced to rotate around the pivot shaft 42 in the clockwise direction in FIG. 2, thereby pivoting the upright member 40*a* in a direction towards the bobbin 1, 1 . . .

At the instant when the air cylinder 44 is fully extended, the aforesaid members including the flocked belt 21, the comb wheel 31 and the like as well as the stepped cam slot 45 all take the positions as shown by the solid lines in FIG. 2, and the frame 40 takes the upright position as shown by the solid lines in FIG. 2.

On the other hand, when the operating rod of the air cylinder 44 is contracted from its fully extended position, the aforesaid members move in the directions opposite those in which they move as the air cylinder 44 is extended as described above. Namely, in this case, as the slide base 145 moves rearwards, the above members including the flocked belt 21, the comb wheel 31 and the like are likewise displaced rearwards and at the same time, the follower 43 is pushed up along the slant portion 45*a* of the stepped cam slot 45 so that the rockable frame 40 is forced to rotate in the counterclockwise direction in FIG. 2, making the upright member 40*a* inclined in a direction away from the bobbins 1, 1 . .

In this manner, the above members including the flocked belt 21, the comb wheel 31 and the like can be simultaneously moved, together with the upright member 40*a* of the rockable frame 40, either in a direction toward each other or in a direction away from each other under the action of the air cylinder 44.

The presser wheels 41, 41 . . . are rotatably mounted on the upright portin 40*a* of the rockable frame 40 at upper and lower locations corresponding to the upper and lower flanges 1*a*, 1*b* of the roving bobbins 1, 1 . . . so that when the the upright portion 40*a* is in an upright position shown by solid lines in FIG. 2, the presser wheels 41, 41 . . . are brought into contact with the outer surfaces of the flanges 1*a*, 1*b* of the respective roving bobbins 1, 1 . . . , thereby pressing the roving bobbins against the surface of the flocked belt 21. In this state, every one of the roving bobbins 1, 1 . . . is acted upon by an upper pair of presser wheels 41, 41 and a lower pair of presser wheels 41, 41, as depicted in FIG. 1.

In this connection, it is to be noted that the number of the roving bobbins 1, 1 . . . opposing the flocked belt 21 is optional and can be arbitrarily selected according to the longitudinal length of the belt 21.

As illustrated in FIGS. 1 and 2, a plurality of stoppers 46, 46 . . . each in the form of a letter V project from the rockable frame 40 at locations intermediate adjacent ones of the roving bobbins 1, 1 . . . and at a height substantially corresponding to the lower flange 1*b* of each bobbin 1 so as to restrain displacement of the bobbins. A plurality of belt supports 23, 23 . . . each having a length or width corresponding to the entire width of the flocked belt 21 are disposed on the back surface of the front side portion of the flocked belt 21 at locations substantially corresponding to the V-shaped stoppers 46.

A plurality of air nozzles 47, 47 . . . are mounted on the upright portion 40*a* of the rockable frame 40 in a horizontally inclined manner (see FIG. 1) at a vertical location corresponding to the annular sticking cloths secured to the respective roving bobbins 1, 1 . . . (see FIG. 2), the tip end of each air nozzle 47 being oriented substantially in a direction tangential to the corresponding one of the roving bobbins 1, 1 . . . , and being spaced from a point of contact on the bobbin, for example, by a distance of 70 mm (see FIG. 6). The tip end of each air nozzle 47 has a bore 47*a* of a 1.5 mm diameter formed therethrough for ejecting a stream of compressed air, supplied from a source of compressed air (not shown) to the air nozzle, at a prescribed pressure such as, for example, 5 $Kg/cm^2$ toward the hairs 2*b*, 2*b* . . . on the surface of the sticking cloth 2 from the back side thereof. In this connection, it is to be noted that the direction of the air stream ejected from the air nozzle 47 may be displaced from the tangential direction of the corresponding roving bobbin 1 toward the central axis thereof to some extent.

Figure 9:
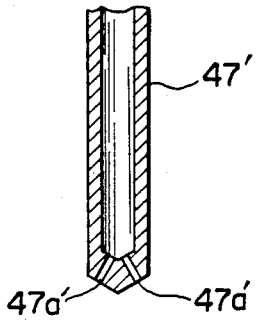
FIG. 9 is a vetical sectional view showing another modified form of an air nozzle.
Figure 8A:
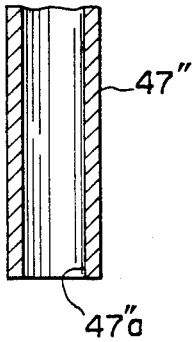
FIG. 8A is a vertical sectional view showing a part of a modified form of an air nozzle.
Figure 8B:
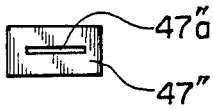
FIG. 8B is a bottom view of the air nozzle shown in FIG. 8A.

Further, the tip end of each air nozzle 47 can be configured in the manner as shown in FIGS. 8A and 8B or FIG. 9. In FIGS. 8A and 8B, an air nozzle 47″ has a slit-like bore 47″*a* so that air ejected from the bore 47″*a* can be directed toward the sticking cloth 2 over the entire width thereof in a uniform manner. This provides a remarkable advantage that residual fibers S on the sticking cloth 2 over the entire width thereof can be removed in a sheet-like manner at one time by a stream of compressed air, thus enabling efficient removal of the residual fibers in a shorter time than that required with the air nozzle 47 shown in FIG. 6.

In FIG. 9, an air nozzle 47′ has two bores 47′*a* which are arranged in a manner such that air ejected from the bores 47′*a* is directed toward the entire width of the sticking cloth 2. This air nozzle 47′ provides an intermediate perfomance between the nozzle 47 in FIG. 6 and the nozzle 47″ in FIGS. 8A and 8B.

Figure 4:
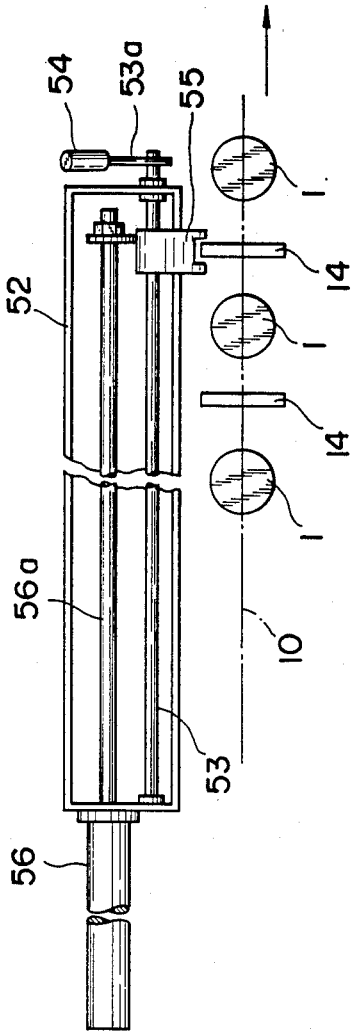
FIG. 4 is an enlarged view seen in the direction designated by an arrow Z in FIG. 2.

As shown in FIGS. 2 and 4, a plurality of feed members 14, 14 . . . are mounted on an upper portion of the bobbin conveyance device 10 at a vertical location intermediate the rail 11 and the bobbin hangers 13, and disposed along the travelling direction of the bobbin conveyance device 10 at locations intermediate adjacent ones of the roving bobbins 1, 1 . . . so that by moving the feed members 14, 14 . . . in the travelling direction of the bobbin conveyance device 10, the wheels 12, 12, rotatably mounted on the axle shaft 12*a* connected with a corresponding one of the feed members 14, 14 . . . , are caused to roll on the bottom portion of the portal-shaped rail 11 thereby to convey the roving bobbins.

Disposed above the oscillating frame 40 is a fixed frame 51 on which a support frame 52 is mounted for rotatably supporting a spline shaft 53 which is caused to rotate by means of an air cylinder 54 through a pair of links 53*a* and 53*b*. On the other hand, an engagement member 55 is mounted on the spline shaft 53 for axial sliding movement relative thereto, and has a distal end which is releasably engageable with a one of the feed members 14, 14 . . . in accordance with rotation of the spline shaft 53 in one or the other direction. As seen from FIG. 4, the engagement member 55 is futher connected with a distal end of a piston rod 56*a* of an air cylinder 56, which is fixedly mounted on one end of the support frame 52, so that it is caused to axially slide along the spline shaft 53 in accordance with the extending or contracting motion of the piston rod 56*a*. The stroke of the air cylinder 56 is set in a manner such that a predetermined number of roving bobbins 1, 1 . . . corresponding to the number of the roving bobbins to be arranged over the length of the flocked belt 21, can be placed into contacting engagement with the flocked belt 21 by one extending stroke of the air cylinder 56.

In operation of the above-described apparatus, motors (not shown) for driving the belt wheels 22, 22 and the comb wheel 31 are first actuated by turning on power switches (not shown) so that the flocked belt 21, entrained around the belt wheels 22, 22, and the comb wheel 31 are driven to run in the respective directions designated by arrows in FIG. 1. Then, the air cylinder 44 is operated to contract so that the flocked belt 21 and the comb wheel 31 mounted on the slide base (not shown) are moved away from the bobbin conveyance device 10, and the rockable frame 40 is inclined so as to provide wide spaces on the opposite sides of the bobbin conveyance device 10 at its inlet end for incoming roving bobbins 1, 1 . . . , as illustrated by two-dot long and two short dashes line in FIG. 2.

In this state, when the air cylinder 54 is operated to extend, the spline shaft 53 is caused to rotate by means of the air cylinder 54 through the links 53*a* and 53*b* so that the engagement member 55 is brought into engagement with one of the feed members 14, 14 . . . of the bobbin conveyance device 10, as shown in FIGS. 2 and 4. The air cylinder 56 is then operated to extend so that the bobbin conveyance device 10 is driven forward to thereby move the roving bobbins 1, 1 . . . suspended from the bobbin hangers 13 toward the positions in which they face the flocked belt 21. The roving bobbins 1, 1 . . . thus moved are stopped at positions intermediate the adjacent ones of the belt supports 23, 23 . . . disposed on the back surface of the front portion of the flocked belt 21.

Subsequently, by extension of the air cylinder 44, the flocked belt 21 and the comb wheel 31 are driven to move forward in unison and at the same time, the rockable frame 40 is rocked around the pivot shaft 42 to the upright position designated by the solid line in FIG. 2, whereby the presser wheels 41, 41 . . . mounted on the rockable frame 40 come into contact, in upper and lower pairs, with the the upper and lower flanges 1*a* and 1*b* of the respective roving bobbins 1, 1 . . . and press them against the surface of the flock belt 21. Simultaneously with this, the flocked belt 21 is being driven to move forward, as shown in FIG. 1, so that the roving bobbins 1, 1 . . . are brought inbetween the rockable frame 40 and the flocked belt 21 with the cylindrical peripheral surfaces of the respective bobbin tubes 1*c* being pressed against the flocked surface of the belt 21, and the mutual positions of the respective bobbins 1, 1 . . . are finely adjusted. As the belt 21 is travelling, the roving bobbins 1, 1 . . . thus pressed against the belt 21 are held between the rockable frame 40 and the belt 21 and caused to rotate in a direction indicated by an arrow A in FIG. 5 so that the residual rovings S wound around the roving bobbins 1, 1 . . . are engaged with the hairs 21*b*, 21*b* . . . on the surface of the belt 21 and removed and carried away from the roving bobbins in the travelling direction of the belt 21. Inthis regard, due to the fact that the winding direction of the residual roving S on each roving bobbin 1 is the same as a direction indicated by an arrow A in FIG. 6 in view of the direction in which the hairs 2*b*, 2*b* . . . on the sticking cloth 2 are laid down, the residual roving S are successively unwound from the bobbin 1 from its outermost layer in accordance with the rotation of the bobbin 1. As a result, even if the residual roving S is wound around the roving bobbin 1 in a multi-layered manner, removal of such residual roving S can be effected in a most smooth and efficient manner.

In cases where multi-layered residual roving S, remaining on a roving bobbin, is unwound and removed therefrom, the apparent outside diameter of the roving bobbin is decreasing as the residual roving S is being removed. In this case, the air cylinder 44 is continuously operated to maintain the rockable frame 40 at the upright position and at the same time to move the flocked belt 21 in the forward direction as far as the air cylinder 44 has not been fully extended with the roller 43 on the horizontal portion 40*b* of the rockable frame 40 being on the inclined surface of the stepped cam 45, as a result of which there is no fear of the roving bobbin 1 being moved away from the surface of the flocked belt 21 even when the apparent outside diameter of the roving bobbin 1 decreases. Similarly, the above is also applicable to cases where the apparent ouside diameters of the respective roving bobbins 1, 1 . . . in contact with the flocked belt 21 differ from each other. Specifically, in such cases, removal of a residual roving S on a roving bobbin 1 having a largest apparent outside diameter will take place first, and as the apparent outside diameter of the bobbin is gradually decreasing, remaining roving bobbins of lesser apparent outside diameters are successively placed in contact with the surface of the flocked belt 21 according to the decreasing apparent outside diameters whereby the residual rovings S on all the roving bobbins 1, 1 . . . can be ultimately removed.

Moreover, due to the belt supports 23, 23 . . . disposed on the back surface of the front portion of the flocked belt 21, the roving bobbins 1, 1 . . . , being pressed against the belt 21, force the belt 21 to flex between the adjacent ones of the belt supports 23, 23 . . . so that the respective roving bobbins 1, 1 . . . are caused to rotate in respective recesses formed by flexing of the belt 21, thus ensuring stable and reliable contact between the roving bobbins 1, 1 . . . and the belt 21. In this regard, the amount of flexure of the belt 21 can be adjusted in an appropriate manner by means of the elasticity of the belt 21 itself as well as by regulating the tension applied to the belt 21 by changing the distance between the belt wheels 22, 22 under the action of an air cylinder (not shown) associated therewith.

Although the residual roving S on the roving bobbin 1 is almost unwound and removed therefrom, there will usually remain waste fibers separated from the residual roving S and attached to the entire surface of the sticking cloth 2 since fibers constituting the wind-starting end of the roving are strongly engaged with the hairs 2*b*, 2*b* . . . on the surface of the sticking cloth 2 so as to provide intimate contact therebetween. Accordingly, by ejecting air frm the air nozzles 47, 47 . . . , a jet of air thus ejected from each of the air nozzles 47, 47 . . . is directed toward the hair 2*b*, 2*b* . . . on the sticking cloth 2, laid down in a circumferential whereby the waste fibers can be blown off in a very simple and easy manner. The waste fibers thus blown off from the sticking cloth 2 fly in the air toward the flocked belt 21 and are attached thereto and carried away therewith.

A mixture of the residual roving S and the waste fibers attached to the surface of the flocked belt 21 (hereinafter referred to as opening wastes) is carried by the belt 21 travelling around the belt wheels 22, 22 to the position of the back side portion of the belt 21 where the surface of the belt 21 is brought into contact with the comb wheel 31, as illustrated in FIG. 1, so that the opening wastes on the surface of the belt 21 are removed by the comb plates 31*b* of the comb wheel 31. Since the peripheral speed of the comb wheel 31 is greater than the travelling speed of the flocked belt 21, the saw teeth 31*c* on the comb plates 31*b* comb the hairs 21*b*, 21*b* . . . on the surface of the belt 21 from the back thereof, thereby removing the opening wastes attached to the belt surface in a very smooth and efficient manner.

The opening wastes thus removed by the comb wheel 31 are conveyed via the opening duct 32*a* to an opening box (not shown) by means of a suction fan (not shown) and stored therein. Finishing of removal of the residual rovings S from the roving bobbins 1, 1 . . . can be detected by means of the photoelectric elements 32*b* and 32*c* which are provided on the opening duct 32*a* for detecting the presence of opening wastes flowing therethrough.

When all the residual rovings S on the respective roving bobbins 1, 1 . . . have been removed, the air cylinder 44 is operated to contract so that the flocked belt 21 is moved away from the bobbin conveyance device 10 and at the same time the rockable frame 40 is rocked around the pivot shaft 42 to the inclined position designated by two-dot long and two short dashes line in FIG. 2, thereby releasing the roving bobbins 1, 1 . . . from restraint due to the presser wheels 41, 41 and the flocked belt 21. Thereafter, the air cylinder 54 is operated to contract so that the engagement member 55 mounted on the spline shaft 53 is rotated to disengage from the associated one of the feed members 14. Then, by contracting the piston rod 56*a* of the air cylinder 56, the engagement member 55 is caused to move toward the upstream or inlet side of the bobbin conveyance device 10, and the engagement member 55 is again rotated to engage one of the feed members 14, 14 . . . by extending the air cylinder 54. In this state, the feed member 14 freshly engaged by the engagement member 55 is disposed upstream of, and spaced by a distance of a predetermined number of the roving bobbins 1, 1 . . . from a feed member 14 previously engaged by the engagement member 55 so that when the air cylinder 56 is operated to extend, the bobbin conveyance device 10 is driven forward to convey the roving bobbins 1, 1 . . . , from which the residual rovings S have been fully removed, toward the downstream or outlet side of the bobbin conveyance device 10, and at the same time, to introduce into the bobbin conveyance device 10 a predetermined number of fresh roving bobbins 1, 1 . . . which are then subjected to the residual-rovings removing operation as described above.

Although in the foregoing description, the air nozzles 47, 47 . . . are provided for blowing out the waste fibers attached to the sticking cloth 2 at the final stage of the residual-rovings removing operation, they may be omitted in cases where the sticking cloth 2 is not employed for fastening the wind-starting end of a roving to a roving bobbin.

Also, the flocked belt 21 and the comb wheel 31 are mounted on a slide base (not shown) which is adapted to be moved toward and away from the bobbin conveyance deivce 10 under the action of the air cylinder 44, but instead they may be mounted on a stationary frame. More specifically, in cases where the amount of a residual roving S on each of the roving bobbins 1, 1 . . . is limited to be less than a predetermined level, the flocked belt 21 can be disposed at such a location as not to contact the outer surface of the residual rovings S on the roving bobbins 1, 1 . . . , and the roving bobbins 1, 1 . . . hung or suspended from the bobbin hangers 13 can be pressed against the surface of the flocked belt 21 by rocking the rockable frame 40 around the pivot shaft 42. In this case, the slide base can be omitted to simplify the entire construction of the apparatus, but it is necessary to rocking the rockable frame 40 by means of the air cylinder 44 and the stepped cam 45.

Although the rockable frame 40 comprises an L-shaped shaped frame which is adapted to be swung around the pivot shaft 42 in accordance with the movement of the roller 43 which is rollingly movable in the stepped slot 45, it may be replaced with any other appropriate means for selectively displacing the flocked belt 21 toward or away from a row of roving bobbins 1, 1 . . . so that the roving bobbins can be pressed against the belt 21 for removal of residual rovings on the roving bobbins or moved apart therefrom for introduction or discharge of the roving bobbins with respect to the bobbin conveyance device 10. Thus, for example, a frame in the form of a flat plate can be employed which is adapted to move on a horizontal plane in a direction perpendicular to the travelling direction of the flocked belt 21.

Further, in the above embodiment, the feed members 14, 14 . . . , the engagement member 55 releasably engageable with one of the feed members, and the air cylinder 56 for driving the engagement member 55 have been employed for driving the bobbin conveyance device 10 for introduction and discharge of roving bobbins 1, 1 . . . , but instead some other means may of course be employed which acts to pull the bobbin conveyance device 10 at its forward end for driving the entire device.

Moreover, the operation order of the respective air cylinders 44, 54 and 56 can be set such that the air cylinder 56 is first operated to introduce a row of roving bobbins 1, 1 . . . into the bobbin conveyance device 10, and when the roving bobbins 1, 1 . . . thus introduced are held between the rockable frame 40 and the flocked belt 21, the air cylinder 54 is immediately operated to release the engagement between the engagement member 55 and one of the feed members 14, 14 . . . , and the air cylinder 56 is subsequently operated to contract so that the engagement of the engagement member 55 with a fresh one of the feed members 14, 14 . . . has been finished at an engagement position for introducing a fresh row of roving bobbins. In this manner, loss time in driving the bobbin conveyance device 10 can be reduced, and at least one of the bobbin conveyance device 10 and the roving bobbins 1, 1 . . . is always restrained so that there will be no fear of any inconveniences resulting from relative displacement between the bobbin conveyance device 10 and the roving bobbins 1, 1 . . . due to vibrations.

As described in the foregoing, according to the method of the present invention, a jet of air is blown toward a sticking cloth substantially in a tangential direction thereof in such a manner as to oppose the rotation of a roving bobbin while the roving bobbin is caused to rotate in the same direction as that in which a roving is wound around the roving bobbin, so that the air is directed to hairs on the surface of the sticking cloth, laid down in line in one direction, from the back thereof. Consequently, the air thus blown toward the sticking cloth in this manner acts to pull out and strip off the residual roving from the hairs on the surface of the sticking cloth intimately engaged or entangled therewith so that the residual roving on the roving bobbin can be removed in a most efficient manner.

Further, according to the apparatus of the present invention, a plurality of roving bobbins, being rotatably hung from bobbin hangers of a bobbin conveyance device, are held between a flocked belt, travelling in parallel with the bobbin conveyance device, and presser members mounted on a rockable frame so that they are caused to rotate by the travelling flocked belt, thereby unwinding and removing residual rovings on the roving bobbins in an efficient manner. In addition, opening wastes, attached to and carried away by the flocked belt, are continuously stripped off from the flocked belt by means of a comb wheel which is disposed on the back side portion of the flocked belt and which rotates at a peripheral speed greater than the travelling speed of the flocked belt. As a result, the apparatus as a whole can be incorporated in the bobbin conveyance device so as to efficiently remove the residual rovings on the roving bobbins.

What is claimed is:

1. An apparatus for removing residual rovings on roving bobbins and adapted to be incorporated in a bobbin conveyance device, said apparatus comprising:

a flocked belt for removing residual rovings on roving bobbins;

belt drive means coupled to said flocked belt for driving said flocked belt in a path;

a plurality of bobbin hangers for rotatably suspending roving bobbins therefrom;

bobbin conveyance means on which said bobbin hangers are mounted and for conveying said bobbin hangers in a further path parallel to and adjacent a part of said path of said flocked belt with bobbins suspended from said bobbin hangers in positions opposed to the surface of said flocked belt;

a rockable frame movable toward and away from said belt and having presser members thereof for engaging bobbins suspended from said bobbin hangers and pressing them against said flocked belt;

a comb wheel positioned at a point along the remainder of the path of said flocked belt and having comb-like tip portions thereon engagable with said flocked belt for stripping residual rovings from said flocked belt; and means for rotating said comb wheel at a peripheral speed greater than the speed of movement of said flocked belt.

2. An apparatus as claimed in claim 1 in which said flocked belt comprises a ground fabric and a plurality of hairs emplanted on the surface of said ground fabric, said hairs being laid down in a direction in which said flocked belt travels.

3. An apparatus as claimed in claim 1 in which said rockable frame is an L-shaped frame having a horizontal position and an upright portion, and a pivot shaft on which said L-shaped frame is rockably mounted, said upright portion having said presser members mounted thereon, said horizontal portion having at its distal end a roller rotatably mounted thereon, a stepped cam means reciprocable in a horizontal direction and with which said roller is in camming engagement, and cam drive means for driving said stepped cam means for causing said upright portion of said rockable frame to rock around said pivot shaft between an upright position in which said presser members are placed in contact with roving bobbins for urging them against said flocked belt, and an inclined position in which said presser members are spaced from the roving bobbins.

4. An apparatus as claimed in claim 3 in which said flocked belt comprises a ground fabric and a plurality of hairs emplanted on the surface of said ground fabric, said hairs being laid down in a direction in which said flocked belt travels.

5. An apparatus as claimed in claim 3 further comprising a plurality of air nozzles on said rockable frame, one at each position corresponding to the position of a bobbin along said bobbin conveying means and for ejecting air in a tangential direction of a bobbin at a position along the length of the bobbin corresponding to the position of an annular sticking cloth secured to the peripheral surface of the bobbin for attaching a wind-starting end of a roving.

6. An apparatus as claimed in claim 3 in which said flocked belt and said comb wheel are movable in unison toward said further path, and said cam drive means is coupled with said flocked belt and said comb wheel for moving said flocked belt and said comb wheel toward said further path in synchronism with the rocking motion of said upright portion of said L-shaped frame toward the upright position, whereby the roving bobbins are held between said rockable frame and said flocked belt.

7. An apparatus as claimed in claim 6 in which said flocked belt comprises a ground fabric and a plurality of hairs emplanted on the surface of said ground fabric, said hairs being laid down in a direction in which said flocked belt travels.

8. An apparatus as claimed in claim 6 further comprising a plurality of air nozzles on said rockable frame, one at each position corresponding to the position of a bobbin along said bobbin conveying means and for ejecting air in a tangential direction of a bobbin at a position along the length of the bobbin corresponding to the position of an annular sticking cloth secured to the peripheral surface of the bobbin for attaching a wind-starting end of a roving.

9. An apparatus as claimed in claim 8 in which said flocked belt comprises a ground fabric and a plurality of hairs emplanted on the surface of said ground fabric, said hairs being laid down in a direction in which said flocked belt travels.

* * * * *